US005311626A

United States Patent [19]

Strahm

[11] Patent Number: 5,311,626

[45] Date of Patent: May 17, 1994

[54] PROCESS FOR THE WET TREATMENT OF TEXTILE TUBULAR FABRIC

[75] Inventor: Christian Strahm, Bronschhofen, Switzerland

[73] Assignee: Solipat AG, Zug, Switzerland

[21] Appl. No.: 947,697

[22] Filed: Sep. 21, 1992

[30] Foreign Application Priority Data

Sep. 23, 1991 [CH] Switzerland ..... 2812/91-8

[51] Int. Cl.[5] ..... D06B 21/00

[52] U.S. Cl. ..... 8/149.1; 8/151; 68/5 D; 68/9; 68/13 R; 68/22 R; 68/62

[58] Field of Search ..... 8/149.1, 151; 68/5 D, 68/5 E, 9, 13 R, 22 R, 62, 183

[56] References Cited

U.S. PATENT DOCUMENTS

| | | | |
|---|---|---|---|
| 3,074,261 | 1/1963 | Wilcox | 68/5 D |
| 4,166,367 | 9/1979 | Sando et al. | 68/9 |
| 4,182,140 | 1/1980 | Sando et al. | 68/13 X |
| 4,313,235 | 2/1982 | Gotovtseva et al. | 8/149.1 |
| 4,835,992 | 6/1989 | Koch | 68/13 |
| 4,843,669 | 7/1989 | Koch et al. | 68/13 X |

*Primary Examiner*—Philip R. Coe

*Attorney, Agent, or Firm*—Fisher & Associates

[57] ABSTRACT

The fabric (1), which is pre-treated wet and is supplied in strand form, is inflated to form a balloon (15, 15', 15'', 15''') by means of a gaseous medium, is then combined again to form a strand and in strand form is guided through an overflow pipe (17, 17', 17'', 17'''). Subsequently, these process steps are repeated a plurality of times in analogous sequence.

14 Claims, 3 Drawing Sheets

PROCESS FOR THE WET TREATMENT OF TEXTILE TUBULAR FABRIC

The invention relates to a process for the continuous wet treatment of textile tubular fabric, to an apparatus for carrying out this process and to the use of this process.

The object of the present invention is in particular to provide a process which requires significantly less water, chemicals and energy than processes known hitherto to achieve the same wet treatment effect, and in which the passage of the fabric is insensitive to holes in the fabric, permits the greatest variety of fabric web widths, and brings about a high level of washing shrinkage effect.

The object is achieved by a method for the continuous wet treatment of textile tubular fabric, characterized in that said fabric, is pre-treated wet and is supplied in strand form. The method comprises the steps of inflating the fabric to form a balloon by means of a gaseous medium; combining the fabric to form a strand; guiding the fabric in strand form through an overflow pipe; and repeating the above steps a plurality of times in analogous sequence.

As a result of the repeated inflation to form a balloon, effected during the treatment process, the treatment fluid therebetween is repeatedly distributed extremely evenly over the fabric which is meanwhile in a fold-free, untwisted state and which, moreover, during each subsequent combining to form a strand consequently automatically achieves the effect of different strand parts repeatedly coming into mutual contact during the subsequent wet treatment in the overflow pipe.

The subject of the invention is, moreover, an apparatus for carrying out the above process.

The invention will be described below with reference to the drawing, in which.

Figure 1:
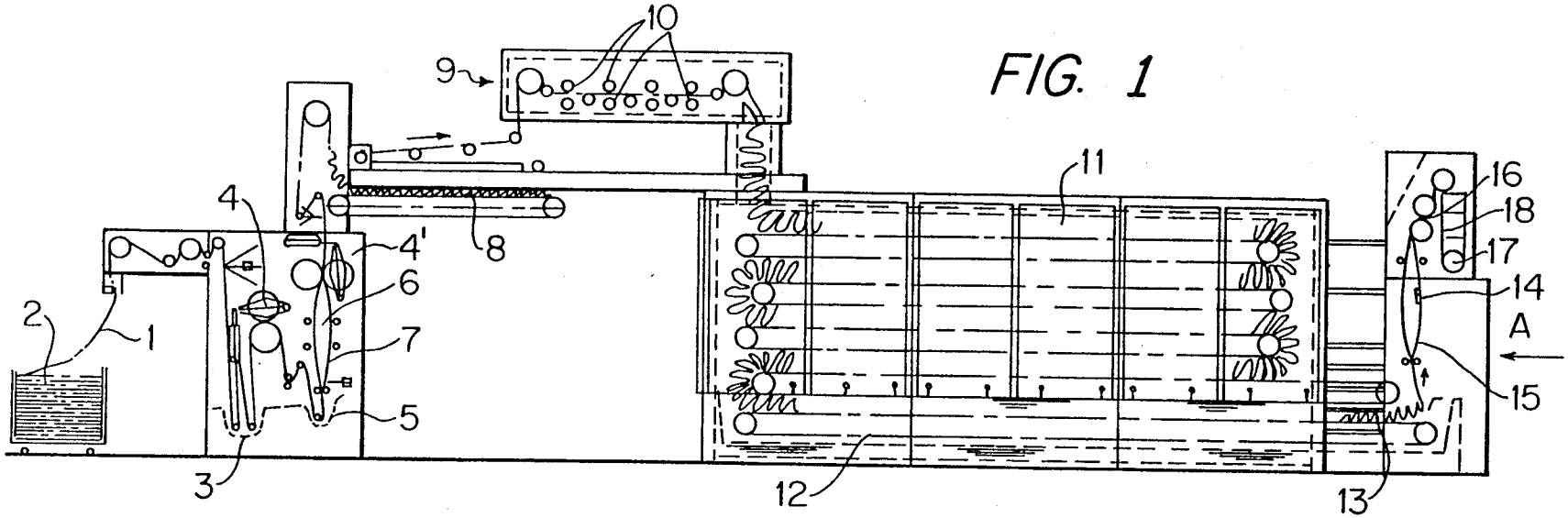
FIG. 1 shows, schematically, a longitudinal section through a part of an embodiment of an apparatus according to the invention for bleaching and washing.

As can be seen from the drawings, the fabric 1 to be treated is drawn off a stack 2, impregnated a first time with the bleaching liquor in the fluid container 3, is then guided through a first open-width squeezing unit 4, and then impregnated a second time with the bleaching liquor in the fluid container 5.

The fabric 1 impregnated thus with the bleaching liquor is then inflated by means of an inflating device 6 to form a balloon 7, so that the impregnating fluid is distributed extremely evenly over the fabric web portion which is in a fold-free state.

Then, the fabric 1 impregnated in this wet manner is supplied through a second open-width squeezing unit 4 to a fabric web store 8 where the fabric 1 dwells for a certain period of time to allow the impregnating fluid to take full effect.

Thereafter, the impregnated fabric 1 is withdrawn in open width from the fabric web store 8 at approximately 100 m/min, and in a heating unit 9 is heated by means of steam nozzles 10 arranged on either side to approximately 95° to 100° C. as it passes through.

Then, the heated fabric 1, still laid out in open-width form, is passed through a steamer unit 11, with a dwell time of for example 30 to 40 minutes and a temperature of approximately 95° to 100° C., and at the outlet of this steamer unit 11 it is also guided continuously through rinsing liquor in the rinsing unit 12 and is then passed into a storage section 13.

The process steps described below are then repeated many times in analogous manner, the same equipment parts being provided with analogous reference numerals.

For reductive after-treatment, the fabric in open-width form is removed from the storage section 13 is combined to form a strand, then inflated by means of an inflating unit 14 to form a balloon 15, so that the rinsing fluid may be distributed extremely evenly over and in the fabric 1 which is presented in fold-free manner and spread out.

Then, if desired, the impregnated, wet fabric 1 may be guided by location 16 through an open-width squeezing unit, containing squeezing rollers, which serve to remove the treatment fabric in open width form after the forming of the fabric into a balloon.

After roller 16, the fabric 1 which passes through at this point in the open-width state is passed into a flushing-in funnel 18 which is in fluid-tight[2] connection with the inlet of the overflow pipe 17, is there combined again to form a strand, and in strand form is passed through the overflow pipe 17 filled with liquor. The length of the overflow pipe 17 in the example illustrated is approximately 9 to 10 meters.

[2] Translator's Note: "flüssigkeitsschichtverbunden" [=in fluid-layer connection] has been assumed to be an error for "flüssigkeitsdichtverbunden" [=in fluid-tight connection] which appears later in the text.

Arranged at the outlet of the overflow pipe 17, for the purpose of draining the liquor out of the fabric 1 which is treated thus, is a fabric store 19 which holds approximately 6 to 8 kg of fabric and is provided with liquor discharge openings, out of which fabric store 19 the liquor passes into the liquor receiving and removing container 20 for further use.

Figure 2:
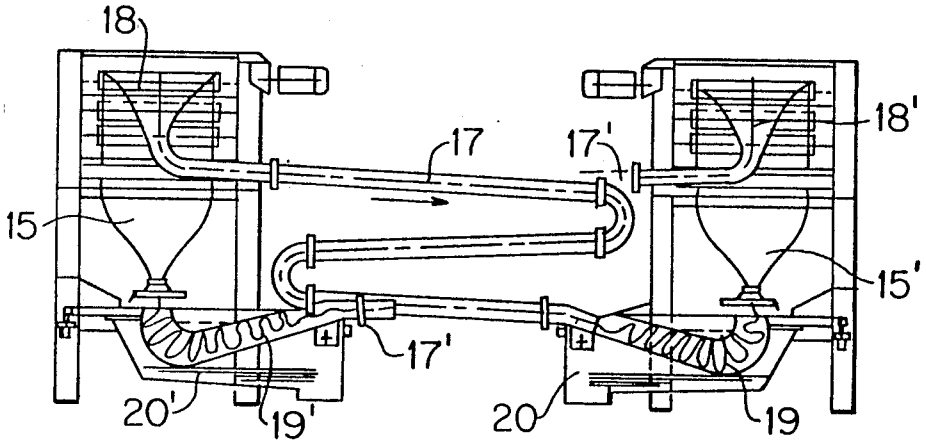
FIG. 2 shows an end view in the direction of the arrow A in FIG. 2.

The fabric 1 to be treated 19 is removed again in the form of a strand from the fabric store 19, inflated to form a balloon 15' by means of an inflating unit 14', so that the rinsing fluid can be distributed again extremely evenly over and in the spread-out fabric 1 which is now again presented in fold-free manner, removed in open width in the open-width state over the roller arrangement located at the point 16', passed into a flushing-in funnel 18' which is in fluid-tight connection with the inlet of the next overflow pipe 17' (not illustrated in FIG. 2 for the sake of clarity), combined again there to form a strand, and in strand form is passed through the overflow pipe 17' filled with liquor.

Arranged at the outlet of the overflow pipe 17', for the purpose of draining the liquor from the fabric 1 which is treated thus, is another fabric store 19' which is provided with liquor discharge openings and out of which the liquor passes into a liquor receiving and removing container 20' for further use.

Figure 3:
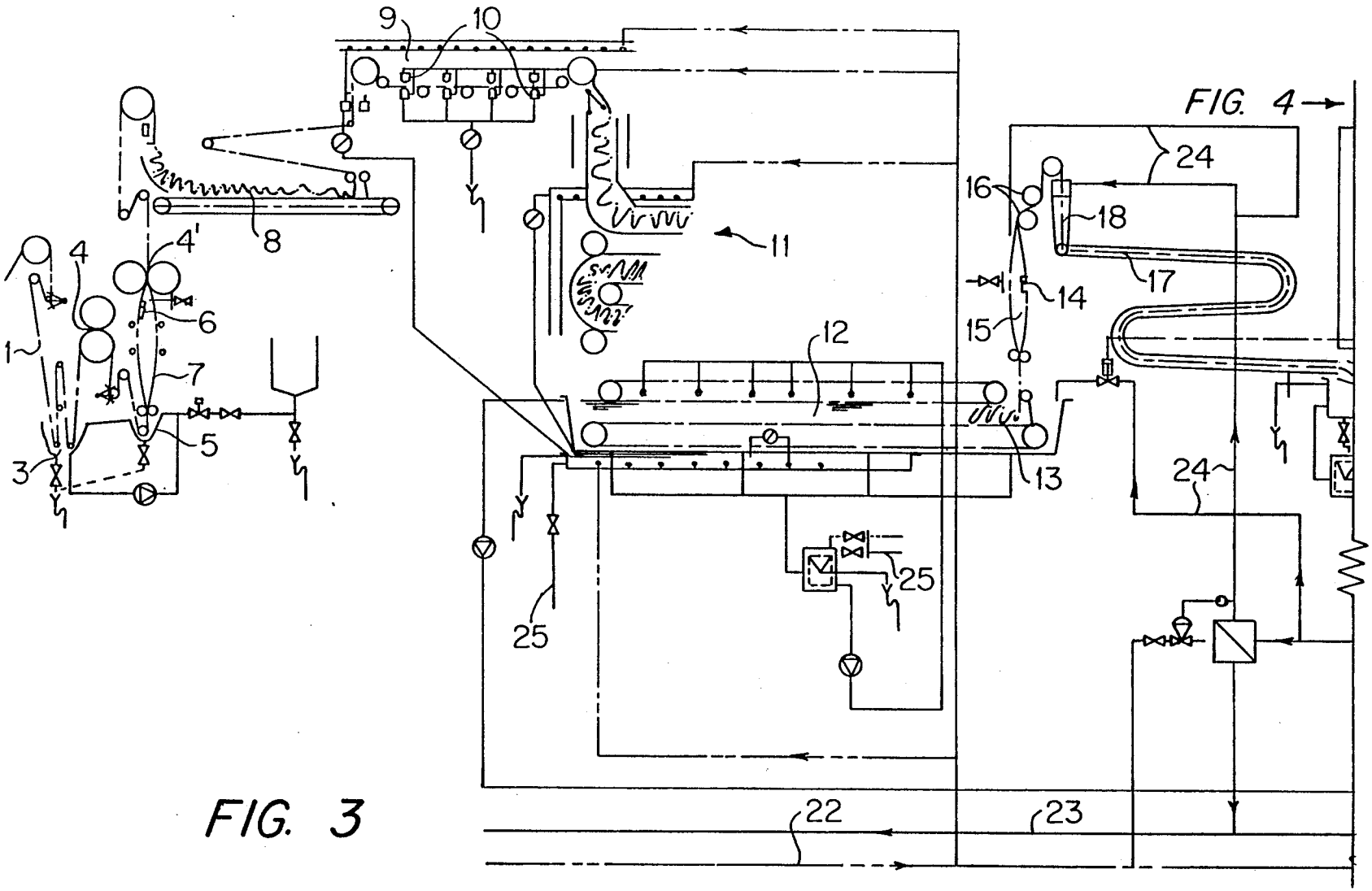
FIG. 3 shows part of the scheme of operation of the apparatus illustrated in FIGS. 1 and 2.
Figures 3, 4:
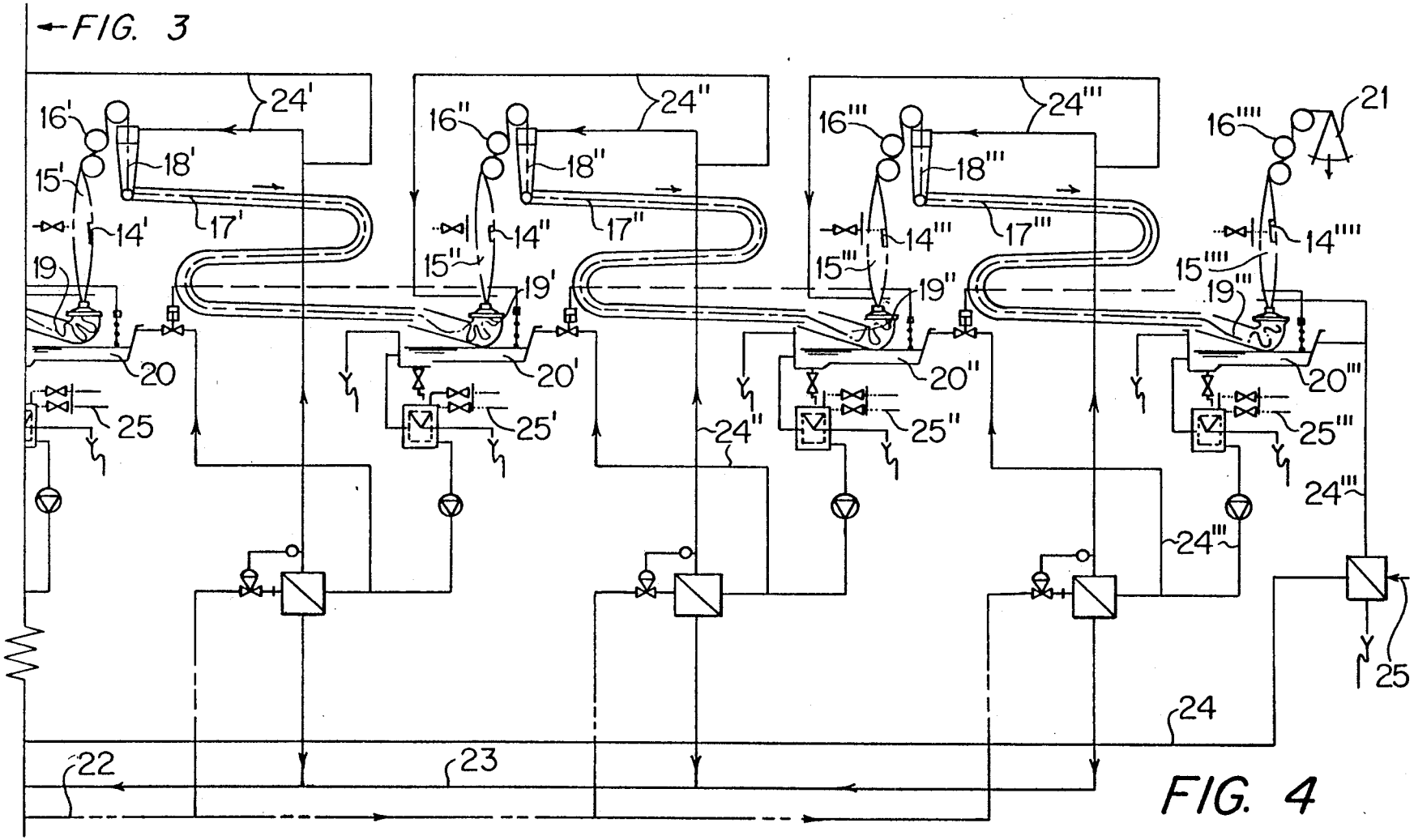
FIG. 4 shows the part of the scheme of operation which adjoins FIG. 3.

These process steps are now repeated a plurality of times, as can be seen in particular in FIGS. 3 and 4.

Fold-free opening, which is repeated a plurality of times, of the fabric to be treated to form a balloon, the subsequent laying out of the fabric in open-width manner, the renewed combining of the fabric 1, which is inevitably different from that carried out previously, to form a strand, the wet treatment thereof, renewed opening of the fabric 1 to form a balloon, etc. effects an extremely intensive wet treatment of the fabric 1 with a minimum of treatment fluid and energy.

As a result of the repeated balloon formation during the washing procedure, a pressing mark which may be made by the roller arrangements 16, 16', 16'' etc. is always moved each time to a different location on the tubular fabric 1, so that no pressing mark can still be detected on the end product.

The fabric 1, its treatment complete, emerges from the plant at the point 21 (FIG. 4).

The provision of saturated steam to the plant is effected by way of the supply line 22, removal of the condensate is effected by way of the line 23, the liquor circulation is effected by way of the lines 24, and the water supply is effected by way of the supply lines 25.

I claim:

1. A method for the continuous wet treatment of textile tubular fabric, characterized in that said method comprises the steps of:

pre-treating said fabric to render said fabric in a wet state and in a strand form;

inflating said fabric to form a balloon by means of a gaseous medium so that a treatment fluid is evenly distributed over said balloon, and said inflating step thereby maintaining said fabric in an open-width form;

combining said fabric in open-width form to return said fabric to said strand form by guiding said fabric in open-width form through an overflow pipe filled with a treatment fluid; and repeating said inflating and combining steps a plurality of times in analogous sequence.

2. The method recited in claim 1, wherein said repeating step is carried out at least four times in series one after the other.

3. The method recited in claim 1, further comprising the step of: squeezing said fabric in open-width form, after said inflating step.

4. The method recited in claim 1, further comprising the steps of:

supplying said fabric in strand form to a storage container from said overflow pipe after said combining step; and removing said fabric in strand form from said storage container after a predetermined dwell time.

5. The method recited in claim 4, wherein said storage container stores 6 to 8 kg of said fabric in strand form.

6. The method recited in claim 1, wherein said fabric in open-width form is removed from said inflating step to said combining step by a roller.

7. The method recited in claim 1, further comprising the steps of:

impregnating said fabric in an open-width flat form initially with a bleaching agent during said pre-treating step;

heating said fabric in said open-width form by steam after said inflating step;

leaving said fabric in said open-width form in a steam chamber for a dwell time of 30 to 40 minutes after said heating step; and subsequently guiding said fabric in said open-width form through a liquid bath before a next balloon formation.

8. The method recited in claim 1, further comprising the steps of:

inflating said fabric in strand form by means of a gaseous medium to form a balloon and thereby render said fabric in an open-width form after leaving said overflow pipe;

removing said fabric in open-width form by a roller from said inflating step; and subsequently squeezing said fabric in open-width form after said inflating step.

9. A method for the continuous wet treatment of textile tubular fabric, characterized in that said fabric is supplied in open-width flat form, said method comprising the steps of:

pre-treating said fabric in said open width flat form with a treatment fluid so as to render said fabric wet and in strand form;

inflating said pre-treated fabric in strand form to form a balloon by means of a gaseous medium so that said treatment fluid is distributed evenly over said balloon form and inflating step thereby maintains said fabric in an open-width form;

reducing said fabric from open-width form to said strand form;

re-inflating said fabric in stand form to form a balloon and thereby returning said fabric to said open-width form so that a second treatment fluid is evenly distributed over said balloon form;

combining said fabric in open-width form to return said fabric to said strand form by guiding said open-width fabric through an overflow pipe filled with a fluid; and repeating said re-inflating and combining steps a plurality of times.

10. The method recited in claim 9, further comprising the steps of:

guiding said pre-treated fabric in said open-width flat form through a first open-width squeezing unit after said pre-treating step; and impregnating said pre-treated fabric in said open-width flat form a second time with said treatment fluid; before said inflating step.

11. The method recited in claim 9, further comprising the steps of:

supplying said fabric in open-width form to a second open-with squeezing unit after said inflating step;

removing said fabric in open-width form from said second open-with squeezing unit and storing said fabric in open width form in a fabric web store; and allowing said fabric in open-width form to dwell in said fabric web store for a predetermined timeperiod.

12. The method recited in claim 11, further comprising the steps of:

removing said fabric in open-width form from said fabric web store and supplying said fabric to a heating unit after said dwelling step;

heating said fabric in open-width form to a predetermined temperature;

steaming said fabric in open-width form for a predetermined time;

rinsing said fabric in open-width form after said steaming step; and storing said fabric in open-width form.

13. The method recited in claim 9, further comprising the steps of:

treating said fabric in balloon form with a rinsing fluid which is evenly distributed over said balloon after said re-inflating step; and supplying said fabric in open-width form to a third open-with squeezing unit for removing said rinsing fluid.

14. A method for the continuous wet treatment of textile tubular fabric, characterized in that said fabric is supplied in open-width flat form, said method comprising the steps of:

pre-treating said fabric in said open-width flat form with a treatment fluid so as to render said fabric wet;

guiding said pre-treated fabric in said open-width flat form through a first open-width squeezing unit;

impregnating said pre-treated fabric in said open-width flat form a second time with said treatment fluid;

rendering said fabric in said open-width flat form to a pre-treated fabric in strand form;

inflating said pre-treated fabric in strand form to form a balloon by means of a gaseous medium, so that said treatment fluid is distributed evenly over said balloon form and said fabric in strand form is rendered to a fabric in open-width form;

supplying said fabric in open-width form to a second open-with squeezing unit;

removing said fabric in open-width form from said second open-with squeezing unit and storing said fabric in open width form in a fabric web store;

allowing said fabric in open-width form to dwell in said fabric web store for a predetermined timeperiod;

removing said fabric in open-width form from said fabric web store and supplying said fabric to a heating unit;

heating said fabric in open-width form to a predetermined temperature;

steaming said fabric in open-width form for a predetermined time;

rinsing said fabric in open-width form after said steaming step;

storing said fabric in open-width form;

reducing said fabric from open-width form to said strand form;

re-inflating said fabric in stand form to form a balloon and thereby returning said fabric to said open-width form;

treating said fabric in balloon form with a rinsing fluid which is evenly distributed over said balloon;

supplying said fabric in open-width form to a third open-with squeezing unit for removing said rinsing fluid;

combining said fabric in open-width form in a funnel to return said fabric to said strand form by guiding said open-width fabric through an overflow pipe filled with fluid; and repeating said re-inflating, treating, supplying and combining steps a plurality of times.

* * * * *